US007262701B1

(12) United States Patent
Nguyen

(10) Patent No.: US 7,262,701 B1
(45) Date of Patent: Aug. 28, 2007

(54) ANTENNA STRUCTURES FOR RFID DEVICES

(75) Inventor: Thanh Huu Nguyen, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 148 days.

(21) Appl. No.: 11/135,055

(22) Filed: May 23, 2005

(51) Int. Cl.
*G08B 13/04* (2006.01)
*H01Q 9/16* (2006.01)

(52) U.S. Cl. ..... 340/572.7; 340/572.4; 340/572.5; 343/822; 343/795; 343/860; 343/700

(58) Field of Classification Search ..... None
See application file for complete search history.

(56) References Cited

U.S. PATENT DOCUMENTS 6,140,924 A * 10/2000 Chia et al. ..... 340/572.5
6,147,606 A 11/2000 Duan ..... 340/572.7
6,621,467 B1 * 9/2003 Marsh ..... 343/850
6,738,025 B2 * 5/2004 Carrender ..... 343/860
7,042,413 B2 * 5/2006 Mazoki et al. ..... 343/795
7,088,299 B2 * 8/2006 Siegler et al. ..... 343/745
7,180,402 B2 * 2/2007 Carrender et al. ..... 340/10.1
2005/0093677 A1 5/2005 Forster et al. ..... 340/10.1
2005/0280512 A1 * 12/2005 Forster ..... 340/10.34

* cited by examiner

*Primary Examiner*—Benjamin C. Lee
*Assistant Examiner*—Son Tang
(74) *Attorney, Agent, or Firm*—Stallman & Pollock LLP

(57) ABSTRACT

An improved antenna structure for RFID tags uses a pair of bent dipole antennas having arms that extend substantially about an outer edge of an RFID substrate. The antennas can be adjusted to resonance at about a half-wavelength of an applied electromagnetic field in the conductive material of the antennas. The antennas can be shorted together using a shorting path, the position of which can be adjusted to adjust an input impedance of the antenna structure. A shorting stub can be used to couple the antenna structure to a supply voltage connection of an RFID device used for the tag. The overall length of the shorting stub can be adjusted to match the impedance of the antenna structure to the impedance of the RFID device. These antenna structures can be used with RFID devices such as CDIP devices and bumped die packages.

20 Claims, 4 Drawing Sheets

ANTENNA STRUCTURES FOR RFID DEVICES

TECHNICAL FIELD OF THE INVENTION

The present invention relates to wireless communication devices, such as Radio Frequency Identification (RFID) devices, including antenna structures.

BACKGROUND

The ability to identify and/or track items such as packages and items of inventory is of great importance in industries such as manufacturing, distributing, and retail sales. Such industries are increasingly moving toward wireless systems that can automatically identify and track these items, as well as being able to communicate information regarding these items, such as identification information, destination, lot number, or even measured parameters such as temperature, lifetime, or status. One method for identifying items and providing information involves attaching a wireless communication device to an item or lot of items. This communication device can include a transponder, or transceiver, which can be easily attached to the item, such as in or on a label or tag for the item. The wireless communication device can respond to commands or instructions included in standard radio frequency (RF) signals.

One wireless communication device that is gaining in popularity is the Radio Frequency Identification (RFID) tag, which can include a transponder or transceiver as known in the art. RFID tags typically are placed onto items to be tracked, such as clothing items in a retail store. The store operates at least one RF zone used to communicate with the various RFID tags. An RF base station or RF reader typically is at the center of each RF zone, designed to generate a continuous wave electromagnetic field at a determined carrier frequency, which currently is 915 MHz in the United States for standard wireless communication. The electric field can be modulated in order to create a data signal that can be carried with the field, at a data rate that typically is lower than the carrier frequency. The modulated signal can be transmitted from an RFID base station. The signal then is received by an RFID tag in the RF zone, such that the tag can determine whether or not to respond, such as by reading an identification code or range of codes contained in the signal. If the RFID tag is to respond, the tag can generate a corresponding modulated RF signal, containing information stored within the tag or determined by the tag, and can transmit the modulated response RF signal to be received by the base station.

There typically are two types of RFID tags: active tags that include an RF transmitter and passive tags that do not include a transmitter, but rely upon modulated back-scattering to provide a return link to an interrogating base station. Passive tags can have an internal power source, such as a battery, or can obtain operating power by rectifying an RF signal transmitted from a base station. Each RFID tag typically has a minimum RF field strength requirement in order to read the incoming signal. An RFID tag powered by electromagnetic field can require substantially more power in the incoming signal than a system having an internal battery. Since field-powered RFID tags do not include a power source, however, these tags typically are much less expensive than active tags containing power sources. Further, field-powered tags are more reliable over time since there is no battery to lose power. RFID tags without power sources also can be simpler and cheaper to produce.

RFID systems have significant advantages over other existing identification and/or tracking systems, as the RFID systems have a rapid read rate, and can read tags that are at a distance from, and/or out of the line of sight of, the base station or tag reader. Further, some RFID tags allow for the updating of information stored within the tag. A typical RFID tag includes a chip coupled to an antenna, such as a dipole antenna as known in the art, formed on a substrate. A problem with such a device is that the orientation of the antenna with respect to the reader can greatly affect the readability of the RFID device, as well as the ability of the device to receive a signal. If the direction of the antenna is substantially parallel to the direction of the electromagnetic field, for example, the RFID device might not pick up a readable signal.

It would be advantageous to increase the reading distance and accuracy of the RFID tags as much as possible, in order to minimize the number of necessary readers and reduce the likelihood of data errors. It also would be desirable to limit the size of the RFID tags, in order to facilitate the application and storage of the tags as well as to lower manufacturing costs. Simply lengthening the antenna to increase the carrier frequency can result in a tag that is too large to be used with a label on a retail item. Further, the transmitting power cannot be increased simply to increase the read distance, as the maximum radiated power is limited by governmental regulation. It also would be advantageous to develop an RFID tag that can read and transmit in substantially any direction, allowing for orientation-independent operation of the RFID tag.

DETAILED DESCRIPTION

Systems and methods in accordance with various embodiments of the present invention can overcome deficiencies in existing wireless devices by providing an improved antenna design, useful for receiving and transmitting wireless signals for various communication devices. A radio frequency identification (RFID) tag in accordance with various embodiments of the present invention can include an RFID tag antenna connected to RFID circuitry, which can include elements such as an integrated circuit, a dual inline package, a temperature sensor, or any other appropriate electronic device. Both the antenna and the circuitry can have an input impedance that can be matched to provide optimal performance. The operating distance of such an RFID tag, which can include the read distance and transmission distance of the tag, can depend at least in part on the impedance of the antenna. Adjusting or tuning the impedance of the antenna can obtain a substantial read distance while maintaining the quality of the read or transmission. An impedance of the RFID tag circuitry can be fixed in certain embodiments, such that the impedance of the tag antenna can be adjusted to maximize the tag read and/or transmission distance for the prescribed circuitry impedance. The geometrical parameters of the tag antenna can be adjusted to control the impedance of the antenna, as well as the gain of the antenna. The geometric properties also can be adjusted to minimize the directionality of the RFID tag.

Figure 1:
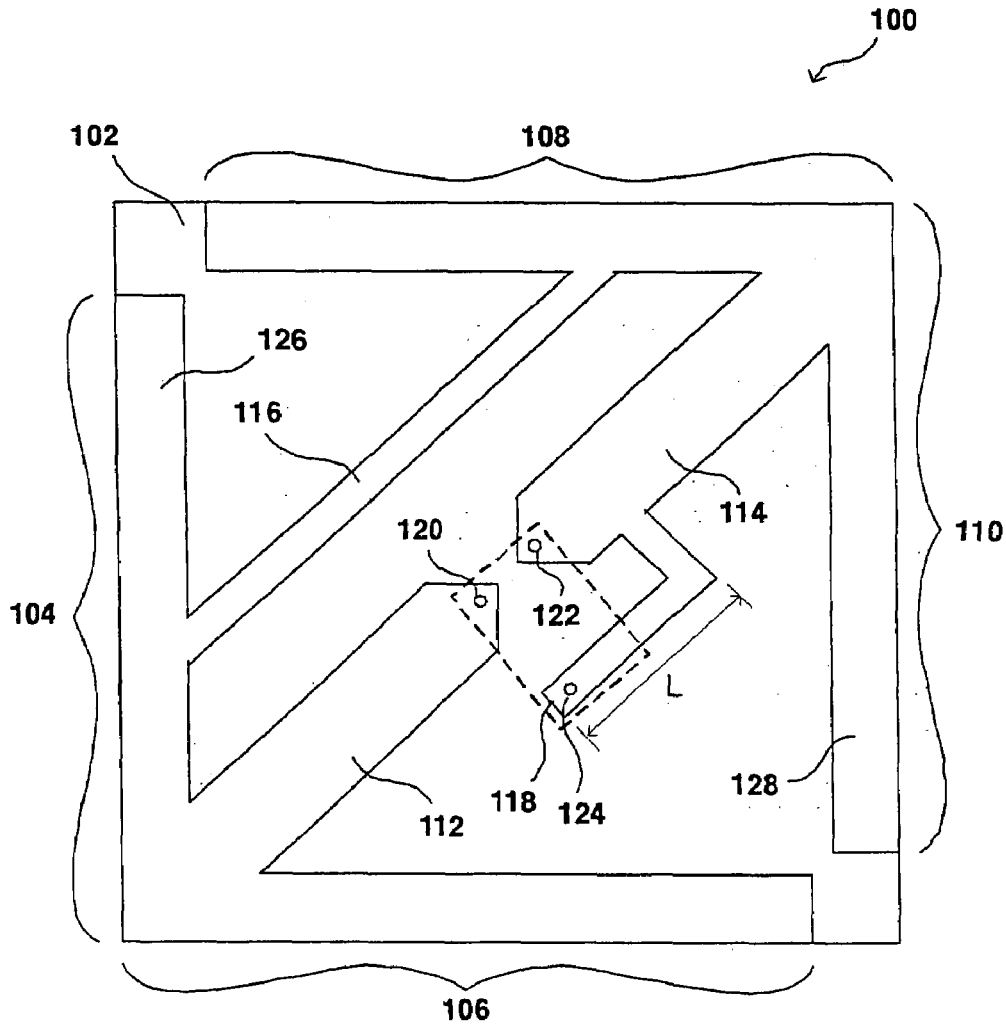
FIG. 1 is a diagram of an RFID antenna that can be used in accordance with one embodiment of the present invention.

FIG. 1 shows an antenna structure 100 that can be used in accordance with a first embodiment of the present invention. This antenna device is designed to be used as an RFID antenna for a wireless communication device, such as a ceramic dual inline package (CDIP) or RFID chip (not shown but located at box 130), which can be used to create a two-port, passive RFID tag. CDIP packages can be used for tracking purposes as discussed above, as well as for tasks such as silicon evaluation, correlation, and working distance testing. Such an antenna allows passive RFID tags to power up using an electromagnetic field emitted from an RFID base station, and to communicate with the base station, at distances up to 30 feet or more. The device can work as a transceiver, in that the CDIP is able to receive a signal from the reader or base station, through the antenna structure, and send a response signal back to the reader. A signal sent from a reader can include identification or targeting information, such that the CDIP only generates a response when identification information contained within the chip is within the targeted range of the signal. The reader can receive and interpret the data sent by the CDIP, such as the identity (ID) of a respective item being scanned into, or tracked in, inventory. The ID can use an approach similar to that of a barcode as used in the art, including information such as item identification, customer, and manufacturer. Alternatively, a base station can send a signal that includes any item identification, such that any RFID tag within the RF zone can respond. This can occur, for example, in a retail location when the retailer wants to know any time an item is brought into, or taken from, that location. As such, the retailer might place a reader by each external door, as known in the art, in order to track any item passing through that door. A computer system in communication with the reader then can update inventory as necessary.

The device 100 in this embodiment has a first radio frequency antenna (RF1) 126 and a second radio frequency antenna (RF2) 128. The antennas can be copper dipole antennas electrically connected to the CDIP, or to an RFID integrated circuit including the CDIP. This antenna is not a straight dipole antenna, but has a shape permitting the antenna to fit within the limited space available within an RFID tag, while providing omni-directionality of the device. For instance, RF1 126 includes first and second arms 104, 106 and a base section 112 used to connect the RF1 antenna to the RF1 port of the CDIP at the RF1 connect point 120. Similarly, RF2 128 includes first and second arms 108, 110 and a base 114 used to connect the RF2 antenna to the RF2 port of the CDIP at the RF2 connect point 122. Many variations of the antenna shape are possible, some of which are discussed in relation to the following figures. In each case the geometric parameters of the antennas are adjusted to maximize the RFID tag read distance and increase the omni-directionality, as discussed above.

The antenna and CDIP can be mounted on an appropriate substrate using, for example, printed circuit board or hybrid circuit technology as known in the art. The substrate can be a standard PC board, formed from a material such as RF4. For each antenna, a pair of conducting strips, such as copper strips, can serve as the arms of the respective antenna. In one embodiment, the copper strips for each antenna were each approximately 64 mm in length, with a width of about 9 mm. The base section was also about 9 mm wide, with a length that is necessary to connect the apex of the angled antenna with the respective connection point.

In order to provide a mechanism for impedance matching for the antenna device relative to the CDIP device, a shorting conductive connection, such as shorting path 116, can be placed at an appropriate location between conductive arms of the antennas. As seen in FIG. 1, the shorting path 116 is placed between arm 104 of RF1 and arm 108 of RF2. The shorting path in this example can be another copper strip, having a width of about 3 mm and a length necessary to connect the arms at the final location of the shorting path. The precise location of the shorting path 116 can be determined by examining the performance of the RFID device, as the circuit path created by the shorting path through the antennas can affect the impedance of the antenna. The shorting arm can be moved toward the RFID chip or CDIP in order to decrease the impedance when necessary, and can be moved away to increase the impedance. In this example, the final location of the shorting path was about 8 mm from the adjacent edge of the antenna bases 112, 114. This can serve as a coarse adjustment of the overall impedance of the antenna structure. If a shorting stub is used, as discussed below, adjustments to the shorting stub can be sufficient to match the impedance such that no adjustments to the shorting path 116 are needed.

The RF1 antenna can be connected to the $V_{SS}$ power terminal of the CDIP, such as by using a shorting stub 118 branching from antenna base 114 to the $V_{SS}$ connection point 124. The stub 118 creates a DC short, with the RF1 antenna being shorted, or electrically coupled, to the RF2 antenna via shorting path 116 as discussed above. The shorting stub can be formed of a copper strip, or other similar material, with a width of about 3 mm in this example. The stub can have a base portion that is about 2 mm in length, and an extension portion sufficient to connect the base portion to the connection point 124. The length, L, of the extension portion of the shorting stub 118 can be adjusted to vary the circuit path length of the device, thereby changing the impedance of the antenna structure. This can serve as a fine adjustment of the impedance of the antenna structure. Decreasing the length of the stub can decrease the impedance of the antenna structure. The length of the shorting stub 118 and the position of the shorting path 116 can be used together to obtain the desired impedance. Since the $V_{SS}$ contact point 124 is somewhat fixed, the length of the stub can be adjusted by changing the location at which the base portion of the shorting stub 118 contacts the base section 114 of the RF2 antenna 128. In other embodiments where the shorting stub might extend to connect to RF1, thereby shorting RF1 and RF2, the base sections of the stub can be adjusted to adjust the impedance.

Although the conductive portions of the antenna structure are described above as being copper strips, there are a number of other materials and forms that can be used to form the antenna structure, such as a continuous single layer of conductive material, such as copper or silver. The material can be formed, deposited, or applied using any appropriate deposition, attachment, or other technique. For example, the conductive layer can be a conductive ink, containing metal particles, that is printed onto the substrate. Alternatively, the conductive layer can be plated onto or adhesively adhered to the substrate. The RFID device can include additional layers, such as protective layers or adhesive layers. The final conductive structure can be directly coupled to the wireless communication device, such as by soldering leads or contact points of the CDIP to the appropriate pads or locations on the conductive antenna structure. Such an RFID device also can utilize any of a number of suitable materials known in the art for the substrate or base material. For example, the substrate can be formed of a suitable plastic material, such as PET or polypropylene, which can be in the form of a flexible film or sheet. The substrate also can be standard PC board such as FR4.

The overall size of the antenna structure allows for significant radiation efficiency. In this embodiment, each antenna is a shaped dipole antenna having an overall electrical length that is close to one-half the wavelength of the RF field, in this case about 15 cm (about 6 inches). Such length can be used to obtain optimal performance in terms of the radiation pattern, the directivity, the gain, and the radiation efficiency of the antenna. The precise length of each antenna can be tuned to resonance at the operational wavelength. A resonant antenna allows the tag to be successfully read at a greater distance, sometimes as much as an order of magnitude greater, than a tag using a non-resonant antenna. If, for example, the RFID system employs a carrier frequency of 915 MHz, the corresponding signal wavelength would be about 32 cm and resonant operation could be obtained using a half wavelength of about 15-16 cm. The actual resonant length will need to be determined, either experimentally or theoretically as known in the art, as the wavelength in the antenna material is not the same as the wavelength in free space, such that the electrical length of the antenna, not the physical length, should approximately equal the half-wavelength of the carrier frequency. The read distance of the tag can be further enhanced by tuning the impedance of the resonant antenna in accordance with the principles of the present invention, as set forth above.

Figure 4:
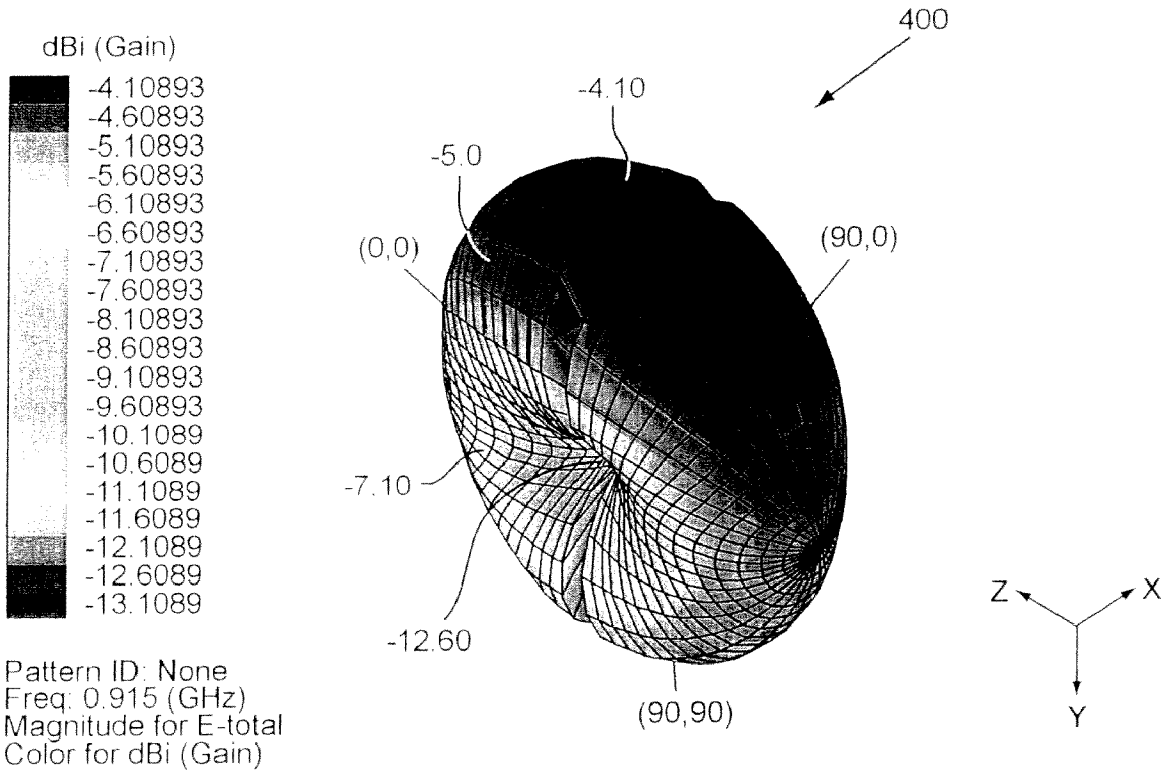
FIG. 4 is a diagram showing a radiation pattern of the device of FIG. 1.

Once the optimal length of each antenna has been determined, the antennas can be sectioned into arms and a base, for example, and the appropriate sections of the antenna can be shaped and positioned substantially about the circumference of the device. Such placement can create a radiation pattern that is omni-directional, which can be advantageous as the transceiver can work from any angle relative to an RF base station or reader. The sectioned and shaped antenna then can be further tuned to resonance for the appropriate field wavelength as described above. An example of a radiation pattern 400 produced by such a device is shown in FIG. 4. In the Figure, the radiation pattern is shown to have a gain in the range of from about −4.1 dBi near an outer circumference of the pattern to about −13.1 dBi near the center of the pattern. The RFID device may exhibit good readability characteristics in substantially any direction within or parallel to the plane of the antenna structure or the RFID device as a whole.

Port matching for the CDIP in one such device is about −15 dB, with about a 15% reflection. Port matching can be optimized by adjusting the length of one of the shorting arms of the device. Additional ports, such as $V_{DD}$ and $V_{SS}$, can create a negligible amount of parasitic capacitance and inductance. The length of the CDIP can increase the inductance of the RFID device since the CDIP acts as an inductive stub. The increased capacitance can be compensated for by reducing the length of the shorting stub. As discussed above, this is a dipole type design, using a pair of shaped dipole antennas 126, 128. The overall size of the antenna device in this embodiment is approximately 3"×3", although other sizes such as 2"×2" could be used as well. The input impedance of one such device is 28.41+j*138@915 MHz, which currently is the standard for wireless communication in the United States. The radiation efficiency of such a device is about 94%. The return loss is −14.67 dB (Zic=73−j*113), with a directivity of 2.44 dBi. An RFID chip can be powered up at powers from about 100 mW to 1 W in one embodiment, with the reader transmitting an RF signal up to about 1 W. Devices of other sizes, such as 2"×2" devices, also can be used but may require adjustments to the design of the antenna structure in order to obtain the required resonance and impedance values.

Figure 2A:
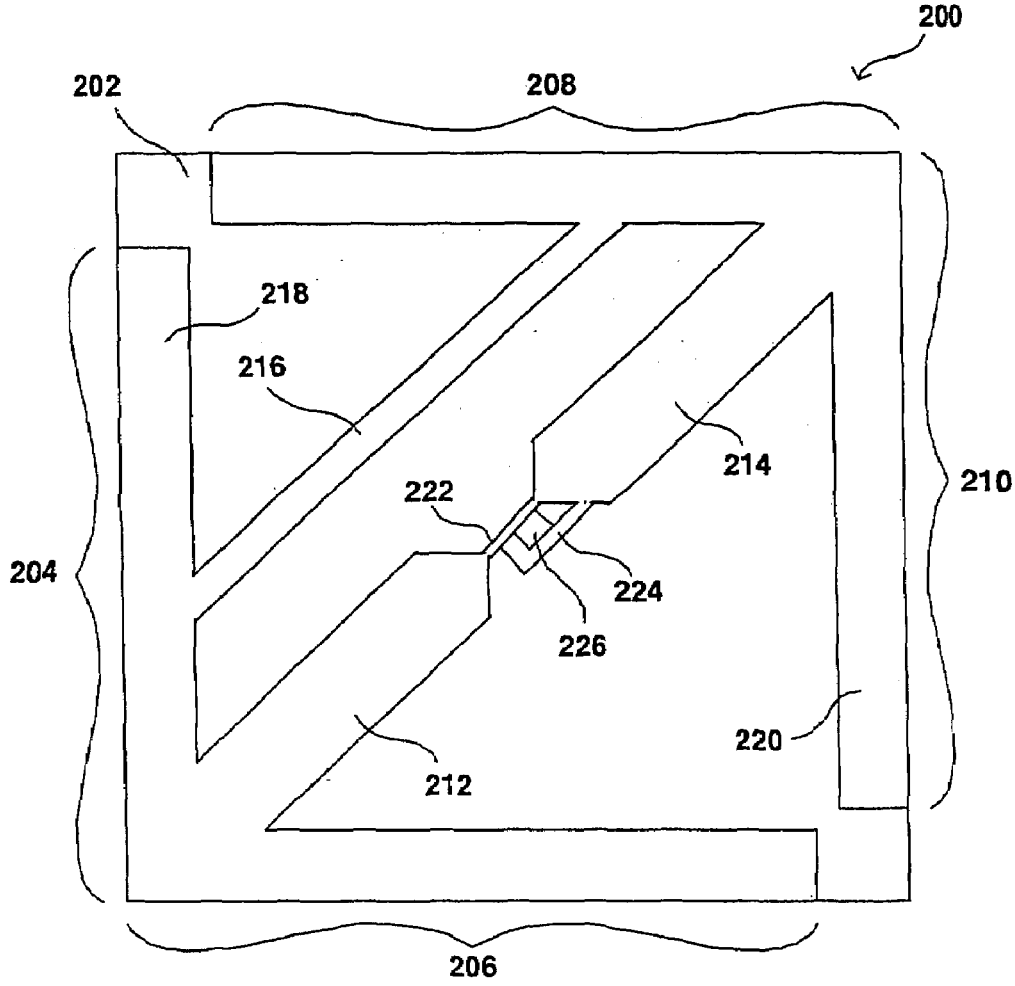
FIGS. 2(*a*) and 2(*b*) are diagrams of an RFID antenna that can be used in accordance with a second embodiment of the present invention.
Figure 2B:
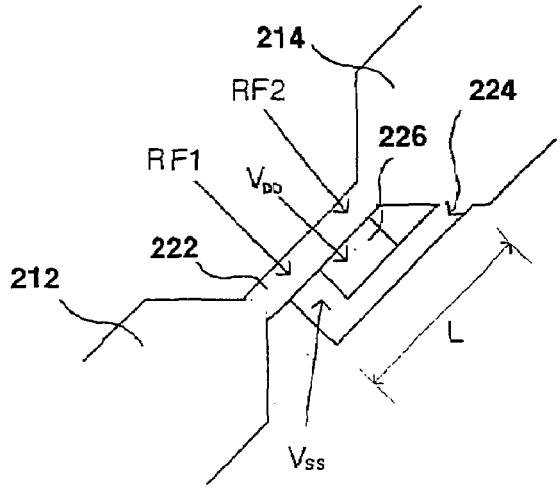

While the design of FIG. 1 is applicable to devices such as CDIP devices, it can be necessary to adjust the structure to work with devices that have different contact point requirements and/or different input impedances. FIG. 2 shows an antenna device 200 that can be used in accordance with a second embodiment of the present invention. This antenna device 200 is designed to be used with an electronic device such as a temperature sensor, which can be placed on a substrate such as a 3"×3" substrate used to form a bumped die package as known in the art. The RF1 antenna in this example is again designed to be connected to the $V_{SS}$ power terminal of the CDIP, here using shorting stub 224. The RF1 antenna is shorted to the RF2 antenna, using shorting path 216. This embodiment will not differ significantly from the design and performance of the embodiment of FIG. 1, but will be configured to connect to a different electronic device having different connection points. For instance, this antenna structure can be used with a temperature sensor in a bumped die package, which can read and transmit the temperature of an item to which the RFID tag is attached. Such functionality allows an RFID reader to monitor the temperature of an item such as frozen food, for example, at multiple times and/or locations. For instance, a producer might wish to track the temperature of an item from a warehouse, through the distribution process, to the final grocery location. The temperature can be read at certain positions, such as during transfer between locations, and/or at discrete intervals, such as every 10-20 minutes. The temperature sensor also can function as a tracking device, as the tag can be setup to respond only when its identification code is included in the signal from the base station. Alternatively, the sensor can be setup to include identification information when responding with the temperature information. As discussed above, the arms 204, 206, 208, 210 can be formed of a length necessary to obtain a half-wavelength for the appropriate field, then tuned to resonance. The base sections 212, 214 connect the arms of the antennas 218, 220 to the connection points for the device. In this case, the base sections can be electrically coupled together directly, such as by using connection path 222, where required by the RFID device. Additional connection pads such as pad 224 can be used if needed to connect to the device, such as to provide a $V_{DD}$ connection point. A shorting path 216 and shorting stub 224 can be used, as described above, to adjust the impedance of the antenna structure to match the input impedance of the RFID device.

The RFID tags of FIGS. 1 and 2 can be used with any appropriate RFID system, with an exemplary RFID system including an RF base station comprising an RF transmitter and an RF receiver. The base station also can include at least one antenna that is connected to the transmitter and/or receiver. In operation, the base station can attempt to locate the tag by generating an RF signal having a carrier frequency as described above. The RF signal is coupled to the antenna of the base station and transmitted to the tag. The RF signal emitted by the antenna then can be received by any tag antenna within range. If the strength of the field at the location of the tag antenna is above a minimum read threshold, the RF tag can respond by modulating the RF carrier to include information about the associated item in the RF field transmitted by the RFID tag, which then can propagate back to the base station. The RF signal transmitted by the base station must have sufficient field strength, taking into consideration the location of the tag. The strength of the signal does not depend on the polarization of the signal relative to the orientation of the tag antenna, however, as the RFID devices in these embodiments work in substantially any direction.

Any of the antenna configurations discussed above may be used in conjunction with a ground plane located on the opposite side of the substrate. Additional antennas can be combined on the same substrate to increase the bandwidth of the device.

Figure 3:
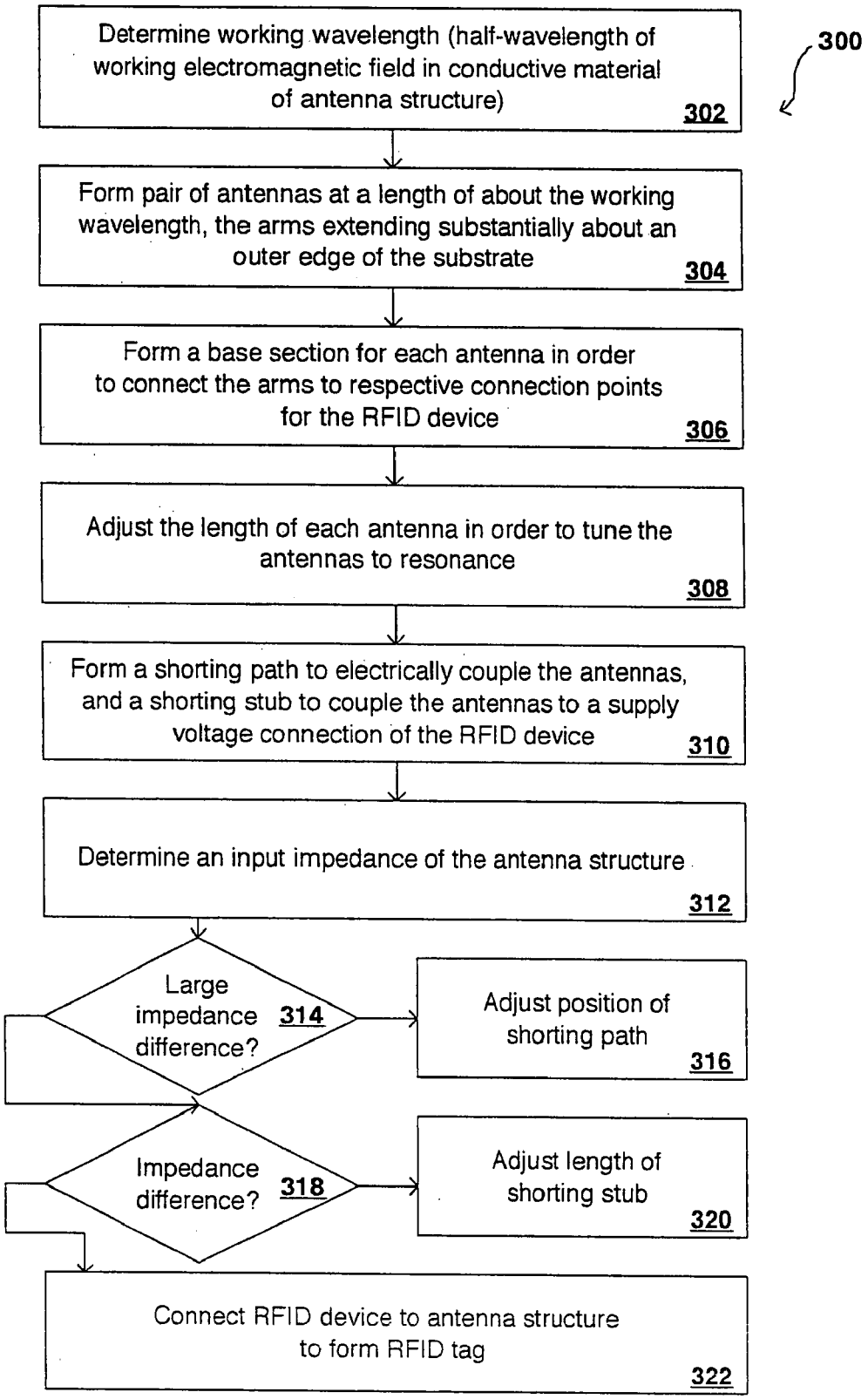
FIG. 3 is a flowchart showing the steps of a method for manufacturing an antenna in accordance with one of the embodiments of FIGS. 1 and 2.

FIG. 3 shows the steps of an exemplary process 300 for forming an antenna structure in accordance with one embodiment of the present invention. In this process, a determination is made as to the working wavelength of the antenna, which corresponds to about one half wavelength of the to-be-applied electromagnetic field in the conductive material to be used to form the conductive structure 302. A pair of antennas then is formed on a rectangular substrate, each antenna having two arms forming an antenna, each edge of the substrate having an adjacent one of the antenna arms such that the antenna structure extends substantially about an outer edge of the substrate 304. A base section is formed for each antenna, in order to connect the arms to the appropriate connection point 306. The base sections can be formed at the same time as the antenna arms. Each antenna can be tuned to resonance by adjusting the effective length of the antenna 308. A shorting path can be formed to electrically couple the antennas, and a shorting stub can be formed to connect the antennas to a supply voltage connection point 310. The impedance of the antenna structure can be determined 312. If the difference between the impedance of the antenna structure and the RFID device to be connected is greater than an adjustable amount of the shorting stub 314, a position of the shorting arm can be adjusted to bring the impedance difference to within an adjustable amount for the shorting stub 316. If the antenna structure is not matched to the RFID device 318, the length of the shorting stub can be adjusted to match the impedance of the antenna structure to the impedance of the RFID device 320. The RFID device can be connected to the antenna structure to form an RFID tag 322.

It should be recognized that a number of variations of the above-identified embodiments will be obvious to one of ordinary skill in the art in view of the foregoing description. Accordingly, the invention is not to be limited by those specific embodiments and methods of the present invention shown and described herein. Rather, the scope of the invention is to be defined by the following claims and their equivalents.

What is claimed is:

1. An antenna structure for a wireless communication device, comprising:

a pair of antennas formed on a substrate, each antenna having two arms formed along adjacent edges of the substrate such that the antenna arms extend substantially about an outer edge of the substrate, each antenna further having a base section connecting the respective antenna to a connection point for the wireless communication device;

a shorting path connecting the pair of antennas in order to electrically couple the antennas; and a shorting stub connecting one of the pair of antennas to a voltage connection point for the wireless communication device, the length of the shorting stub being selected so as to match an impedance of the antenna structure with an input impedance of the wireless communication device.

2. An antenna structure according to claim 1, wherein:

a position of the shorting path is selected to control a relative impedance of the antenna structure and the wireless communication device.

3. An antenna structure according to claim 1, wherein:

the wireless communication device is a ceramic dual inline package.

4. An antenna structure according to claim 1, wherein:

the wireless communication device includes a temperature sensor.

5. An antenna structure according to claim 1, wherein:

the wireless communication device is a bumped die package.

6. An antenna structure according to claim 1, wherein:

the antenna structure and wireless communication device form a Radio Frequency Identification (RFID) tag.

7. An antenna structure according to claim 1, wherein:

a length of each of the pair of antennas is selected to be approximately equal to one-half of the wavelength of an external electromagnetic field used to provide power to the wireless communication device.

8. An antenna structure according to claim 7, wherein:

each of the pair of antennas is tuned to resonance with respect to the electromagnetic field.

9. An antenna structure according to claim 7, wherein:

the pair of antennas is formed from copper.

10. A method of forming an antenna structure for a wireless communication device, comprising the steps of:

forming a pair of conductive antennas on a substrate, each of the pair of antennas having two arms formed along adjacent edges of the substrate such that the antenna arms extend substantially about an outer edge of the substrate, each antenna further having a base section connecting the respective antenna to a connection point for the wireless communication device;

forming a conductive shorting path connecting the pair of antennas in order to electrically couple the antennas;

forming a shorting stub connecting one of the pair of antennas to a voltage connection point for the wireless communication device; and adjusting a length of the shorting stub in order to match an impedance of the antenna structure with an input impedance of the wireless communication device.

11. A method according to claim 10, further comprising:

adjusting a position of the shorting path in order to adjust an impedance of the antenna structure relative to an input impedance of the wireless communication device when a difference in impedance between the wireless communication device and the antenna structure is outside an adjustable range of the shorting stub.

12. A method according to claim 10, further comprising:

tuning the pair of antennas to resonance relative to an external electromagnetic field.

13. A method according to claim 10, wherein:

the step of forming a pair of antennas includes forming each antenna to have a length approximately equal to one-half of the wavelength of an external electromagnetic field used to provide power to the wireless communication device.

14. A method according to claim 10, further comprising:

connecting the wireless communication device to the antenna structure.

15. A method according to claim 10, wherein:

the wireless electronic device is one of a ceramic dual inline package and a bumped die package.

16. A method according to claim 10, wherein:

the antenna structure and the wireless communication device form a Radio Frequency Identification (RFID) tag.

17. A Radio Frequency Identification tag, comprising:

a wireless communication device;

a substrate for supporting the wireless communication device;

a pair of antennas forming formed on the substrate, each antenna having two arms formed along adjacent edges of the substrate such that the antenna arms extend substantially about an outer edge of the substrate, each antenna further having a base section connecting the respective antenna to a connection point for the wireless communication device;

a shorting path connecting the pair of antennas in order to electrically couple the antennas; and a shorting stub connecting one of the pair of antennas to a voltage connection point for the wireless communication device, the length of the shorting stub being selected so as to match an impedance of the antenna structure with an input impedance of the wireless communication device.

18. A Radio Frequency Identification tag according to claim 17, wherein:

a length of the shorting stub can be adjusted in order to match an impedance of the antenna structure to an input impedance of the wireless communication device.

19. A Radio Frequency Identification tag according to claim 17, wherein:

a position of the shorting path can be adjusted in order to adjust an impedance of the antenna structure relative to an input impedance of the wireless communication device.

20. A Radio Frequency Identification tag according to claim 17, wherein:

the wireless communication device is one of a ceramic dual inline package and a bumped die package.

* * * * *

UNITED STATES PATENT AND TRADEMARK OFFICE

CERTIFICATE OF CORRECTION

PATENT NO. : 7,262,701 B1
APPLICATION NO. : 11/135055
DATED : August 28, 2007
INVENTOR(S) : Thanh Huu Nguyen It is certified that error appears in the above-identified patent and that said Letters Patent is hereby corrected as shown below:

Column 9, line 12, change "a pair of antennas forming formed" to --a pair of antennas formed--.

Signed and Sealed this

Fourth Day of December, 2007

JON W. DUDAS
*Director of the United States Patent and Trademark Office*